United States Patent [19]

Horvat et al.

[11] Patent Number: 4,843,663

[45] Date of Patent: Jul. 4, 1989

[54] INFLATIBLE MATTRESS WITH ADJUSTABLE INTERNAL PARTITIONS

[76] Inventors: Juro Horvat, Postfacj 1665, 6680 Neukirchen/Saar, Fed. Rep. of Germany; George Spector, 233 Broadway, RM 3815, New York, N.Y. 10279

[21] Appl. No.: 232,595

[22] Filed: Aug. 15, 1983

[51] Int. Cl.[4] ..... A47C 27/10

[52] U.S. Cl. ..... 5/455; 5/447; 5/450; 5/457

[58] Field of Search ..... 5/455, 449, 441, 446, 5/447, 451, 450, 457, 454; 297/DIG. 3

[56] References Cited

U.S. PATENT DOCUMENTS

| | | | |
|---|---|---|---|
| 2,099,870 | 11/1937 | Stanley et al. | 5/455 |
| 2,748,399 | 6/1956 | Rockoff | 5/455 |
| 2,823,394 | 2/1958 | Smith | 5/455 |
| 3,879,776 | 4/1975 | Solen | 5/447 |
| 3,893,198 | 7/1975 | Blair | 5/446 |
| 4,310,936 | 1/1982 | Benjamin | 5/455 |

*Primary Examiner*—Alexander Grosz

[57] ABSTRACT

An air bed is provided and consists of an inflatable mattress that has a plurality of air chambers in which a mechanism is supplied for changing the air pressure within the air chambers so as to adapt to weight and size of a person disposed on the mattress.

3 Claims, 1 Drawing Sheet

INFLATIBLE MATTRESS WITH ADJUSTABLE INTERNAL PARTITIONS

BACKGROUND OF THE INVENTION

The instant invention relates generally to mattresses and more specifically it relates to an air bed.

Numerous mattresses have been provided in prior art that are adapted to include a plurality of inflatable air filled compartments therein. For example, U.S. Pat. Nos. 4,136,412; 4,394,784 and 4,541,135 all are illustrative of such prior art. While these units may be suitable for the particular purpose to which they address, they would not be as suitable for the purposes of the present invention as heretofore described.

SUMMARY OF THE INVENTION

A primary object of the present invention is to provide an air bed that will overcome the shortcomings of the prior art devices.

Another object is to provide an air bed having multiple air chambers in which an adjustment control is provided to change the firmness of air pressure within the air chambers.

An additional object is to provide an air bed which can be quickly inflated and deflated so as to make the air bed simple to transport from place to place.

A further object is to provide an air bed that is simple and easy to use.

A still further object is to provide an air bed that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
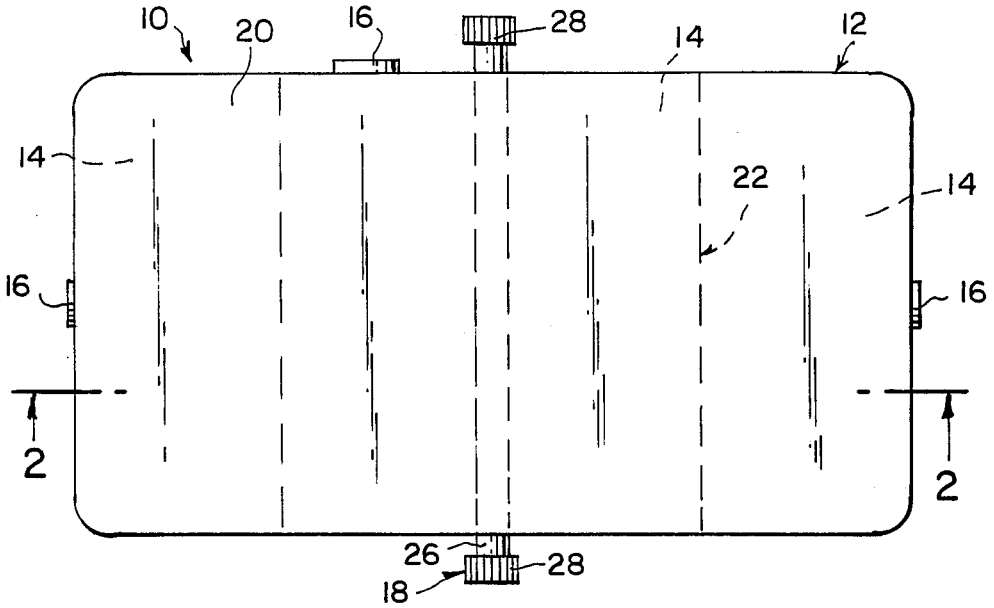
FIG. 1 is a top view of a mattress incorporating the invention inside thereof.
Figure 2:
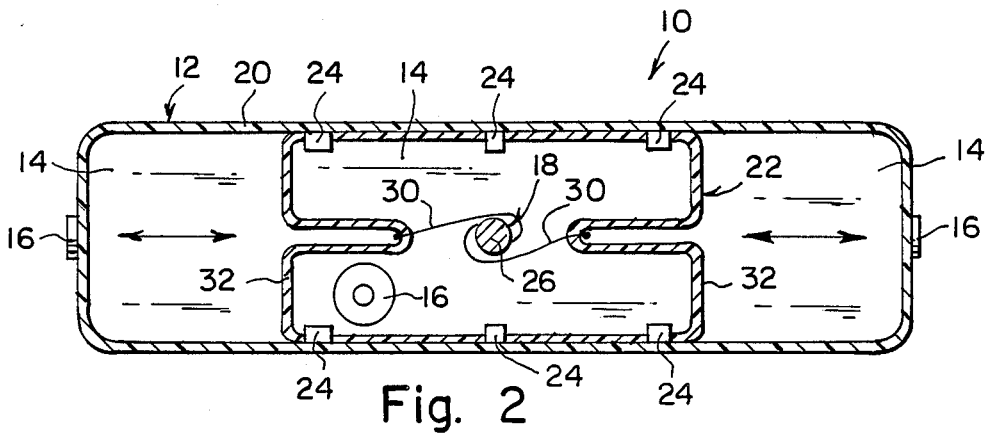
FIG. 2 is a cross sectional view taken along line 2—2 in FIG. 1, showing the three air chambers and an adjustment feature therein.

Turning now descriptively to the drawings, in which similar reference characters denote similar elements throughout the several views, FIGS. 1 and 2 illustrate an air bed 10 consisting of an inflatable mattress 12 that has a plurality of air chambers 14. An air valve 16 is connected to each of the air chambers 14 of the mattress 12 for applying air pressure therethrough. A mechanism 18 is supplied for changing the air pressure within the air chambers 14 of the mattress 12 so as to adapt to weight and size of a person (not shown) disposed on the mattress 12.

The mattress 12 includes an outer casing 20 and an inner inflatable bag 22 centrally secured by clamps 24 within the outer casing 20 to form three air chambers 14 therein for the head, body and feet of the person disposed on the mattress 12.

The air pressure changing mechanism 18 includes a rotatable shaft 26 extending transversely through the inner inflatable bag 22. The shaft 26 has a turn knob 28 formed on each distal end thereof. A pair of cords 30 are each affixed between the shaft 26 and an opposite side 32 of the inner inflatable bag 22 so that when the shaft 26 is rotated manually, the cords 30 will wrap around the shaft 26 and pull the sides 32 of the inner inflatable bag 22 towards each other thus changing size of the inner inflatable bag to change the air pressure in each of the air chambers 14 within the mattress 12.

Figure 3:
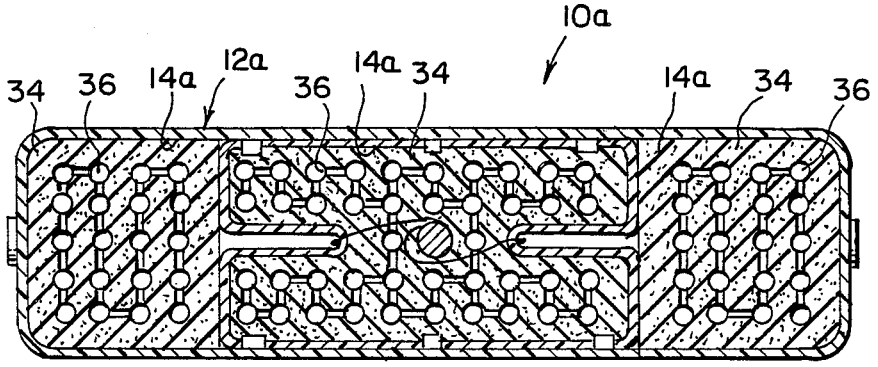
FIG. 3 is a cross sectional view similar to FIG. 2, with foam rubber having interconnecting air cells in the air chambers.

FIG. 3 shows a modified air bed 10*a* which is identical to the air bed 10 except that it includes foam rubber material 34 which has interconnecting air cells 36 within each of the air chambers 14*a* of the mattress 12*a* to aid in supporting the person disposed on the mattress 12*a*.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An air bed which comprises:

(a) an inflatable mattress having a plurality of air chambers;

(b) an air valve connected to each of the air chambers of said mattress for applying air pressure therethrough;

(c) means for changing the air pressure within the air chambers of said mattress so as to adapt to weight and size of a person disposed on said mattress, wherein said mattress further includes:

(d) an inner inflatable bag centrally secured within an outer casing to form three air chambers therein for heat, body and feet of the person disposed on said mattress, wherein said air pressure changing means includes:

(f) a rotatable shaft extending transversely through said inner inflatable bag, said shaft having a turn knob formed on each distal end thereof; and (g) a pair of cords each affixed between said shaft and an opposite side of said inner inflatable bag so that when said shaft is rotated manually said cords will wrap around said shaft and pull the sides of said inner inflatable bag towards each other thus changing the size of said inner inflatable bag to change the air pressure in each of the air chambers within said mattress.

2. An air bed as recited in claim 1, further including foam rubber material having interconnecting air cells within each of the air chambers of said mattress to aid in supporting the person disposed on said mattress.

3. An inflatable mattress comprising an outer casing and a plurality of flexible internal partitions dividing said outer casing into a plurality of separate chambers, means to individually inflate said chambers, and externally operable means having internal attachments in contact with said partitions, said attachments adapted to change the positions of the partitions relative to the outer casing, to thereby cause changes in the pressures within said plurality of chambers.

* * * * *